US008886102B2

(12) United States Patent
Ishida et al.

(10) Patent No.: US 8,886,102 B2
(45) Date of Patent: Nov. 11, 2014

(54) THERMAL FIXING DEVICE HAVING SEALING MEMBER

(71) Applicant: Brother Kogyo Kabushiki Kaisha, Nagoya (JP)

(72) Inventors: Kei Ishida, Nagoya (JP); Kenji Takeuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 44 days.

(21) Appl. No.: 13/738,091

(22) Filed: Jan. 10, 2013

(65) Prior Publication Data

US 2013/0322939 A1 Dec. 5, 2013

(30) Foreign Application Priority Data

May 31, 2012 (JP) ..... 2012-124422

(51) Int. Cl.
*G03G 15/20* (2006.01)

(52) U.S. Cl.
CPC .... *G03G 15/2053* (2013.01); *G03G 2215/2035* (2013.01)
USPC ..... 399/329

(58) Field of Classification Search
CPC ..... G03G 15/2053; G03G 15/2064; G03G 2215/2015; G03G 2215/2035
USPC ..... 399/33, 328, 329
See application file for complete search history.

(56) References Cited

U.S. PATENT DOCUMENTS 8,660,445 B2 * 2/2014 Ishida et al. ..... 399/33
2012/0051809 A1 3/2012 Miyauchi

FOREIGN PATENT DOCUMENTS

JP 2012-053105 A 3/2012

* cited by examiner

*Primary Examiner* — Hoang Ngo
(74) *Attorney, Agent, or Firm* — Banner & Witcoff, Ltd.

(57) ABSTRACT

A thermal fixing device includes a tubular member, an internal thermal fixing assembly, and an external thermal fixing member. The internal fixing assembly is positioned in an internal space of the tubular member and includes a frame, a thread member threadingly engaged with the frame, a fixed assembly fixed to the frame by the thread member, and a sealing member covering one of a boundary between an end portion of the thread member and the frame and a boundary between the end portion and the fixed assembly. The external thermal fixing member is positioned outside of the tubular member for nipping the tubular member in cooperation with the internal thermal fixing assembly.

8 Claims, 6 Drawing Sheets

THERMAL FIXING DEVICE HAVING SEALING MEMBER

CROSS REFERENCE TO RELATED APPLICATION

This application claims priority from Japanese Patent Application No. 2012-124422 filed May 31, 2012. The entire content of the priority application is incorporated herein by reference.

TECHNICAL FIELD

The present invention relates to a fixing device for thermally fixing a developing agent image or a toner image onto a recording sheet.

BACKGROUND

A conventional fixing device includes a tubular member, a nip plate and a metallic stay, and a thermistor. The nip plate and the metallic stay are positioned in an internal space of the tubular member. The thermistor is fixed to the stay by a screw.

SUMMARY

The present invention provides a thermal fixing device for thermally fixing a developing agent image to a sheet including: a tubular member; an internal thermal fixing assembly; and an external thermal fixing member. The tubular member defines an internal space. The internal thermal fixing assembly is positioned in the internal space of the tubular member. The internal thermal fixing assembly includes: a frame made from a metal; a thread member threadingly engaged with the frame and having an end portion; a fixed assembly fixed to the frame by the thread member; and a sealing member covering one of a boundary between the end portion and the frame and a boundary between the end portion and the fixed assembly. The external thermal fixing member is positioned outside of the tubular member and configured to nip the tubular member in cooperation with the internal thermal fixing assembly to provide a nip region at which the developing agent image is thermally fixed to the sheet.

DETAILED DESCRIPTION

Next, a general structure of a laser printer 1 as an image forming apparatus provided with a fixing device 100 according to one embodiment of the present invention will be described with reference to FIG. 1. A detailed structure of the fixing device 100 will be described later while referring to FIGS. 2 through 5.

Throughout the specification, the terms "upward", "downward", "upper", "lower", "above", "below", "beneath", "right", "left", "front", "rear" and the like will be used assuming that the laser printer 1 is disposed in an orientation in which it is intended to be used. More specifically, in FIG. 1 a right side and a left side are a rear side and a front side, respectively. Further, in FIG. 1 a near side and a far side are a right side and a left side.

<Overall Structure of Laser Printer>

Figure 1:
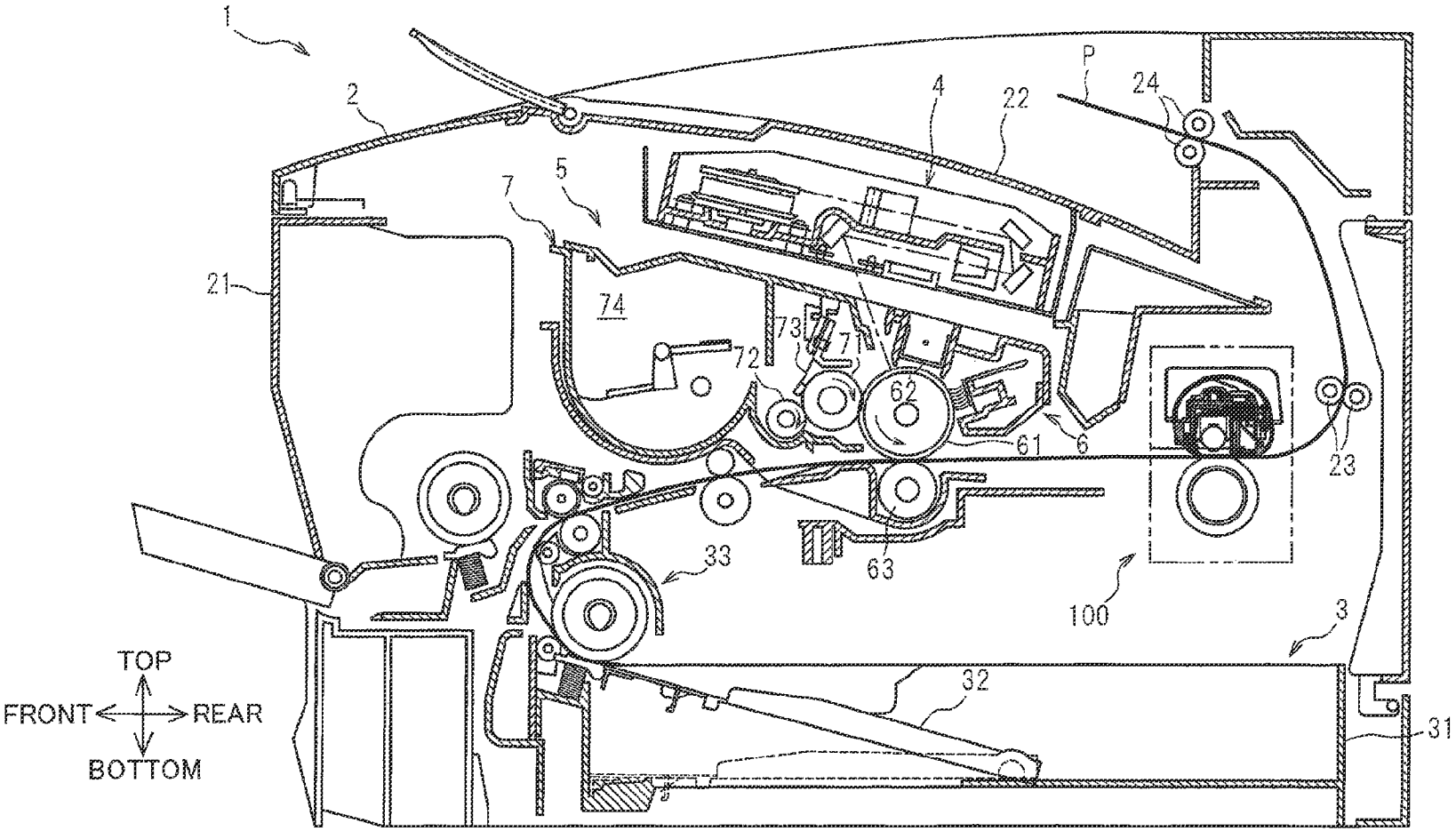
FIG. 1 is a schematic cross-sectional view showing a structure of a laser printer provided with a fixing device according to one embodiment of the present invention.

As shown in FIG. 1, the laser printer 1 includes a main frame 2, a sheet supply unit 3 for supplying a sheet P, an exposure unit 4, a process cartridge 5 for transferring a toner image (developer agent image) onto the sheet P, and the fixing device 100 for thermally fixing the toner image onto the sheet P. The sheet supply unit 3, the exposure unit 4, the process cartridge 5, and the fixing device 100 are provided in the main frame 2. The main frame 2 has a front opening which is opened or closed by a front cover 21.

The sheet supply unit 3 is provided at a lower inner portion of the main frame 2, and includes a sheet supply tray 31, a pressure plate 32, and a sheet supplying mechanism 33. The sheet P accommodated in the sheet supply tray 31 is urged upward by the pressure plate 32, and is supplied to the process cartridge 5, i.e., to a portion between a photosensitive drum 61 and a transfer roller 63 by the sheet supplying mechanism 33.

The exposure unit 4 is positioned at an upper inner portion of the main frame 2, and includes a laser beam emitting portion (not shown), a polygon mirror (shown in FIG. 1 without reference numeral), lenses (shown in FIG. 1 without reference numeral), and a reflection mirror (shown in FIG. 1 without reference numeral). A laser beam based on image data is emitted from the laser beam emitting portion as shown by a dotted chain line, and the beam is subjected to high speed scanning on an outer peripheral surface of the photosensitive drum 61 for exposing the surface to the laser beam.

The process cartridge 5 is positioned below the exposure unit 4, and can be removed from and attached to the main frame 2 through the opening upon opening the front cover 21. The process cartridge 5 includes a drum unit 6 and a developing unit 7.

The drum unit 6 includes the photosensitive drum 61, a charger 62, and the transfer roller 63. The developing unit 7 is configured to be detached from and attached to the drum unit 6, and includes a developing roller 71, a toner supply roller 72, a toner thickness regulation blade 73, and a toner container 74 for accommodating toner (developer agent) therein.

In the process cartridge 5, after the surface of the photosensitive drum 61 has been uniformly charged by the charger 62, the surface is exposed to the laser beam scanning based on the image data by the exposure unit 4. An electrostatic latent image corresponding to the image data is thus formed on the surface of the photosensitive drum 61. The toner accommodated in the toner container 74 is supplied to the developing roller 71 through the toner supply roller 72. The toner is entered into a gap between the developing roller 71 and the regulation blade 73, whereupon a thin toner layer having a uniform thickness is carried on the surface of the developing roller 71.

The toner carried on the developing roller 71 is supplied to the electrostatic latent image formed on the surface of the photosensitive drum 61. Thus, a visible toner image corresponding to the electrostatic latent image is formed on the surface of the photosensitive drum 61. The toner image is then transferred onto the sheet P when the sheet P passes through a confronting region between the photosensitive drum 61 and the transfer roller 63.

The fixing device 100 is positioned rearward of the process cartridge 5. The toner image transferred onto the sheet P is thermally fixed to the sheet P upon passing through the fixing device 100. Then, the sheet P is discharged onto a discharge tray 22 by conveyer rollers 23, 24.

<Detailed Structure of Fixing Device>

Figure 2:
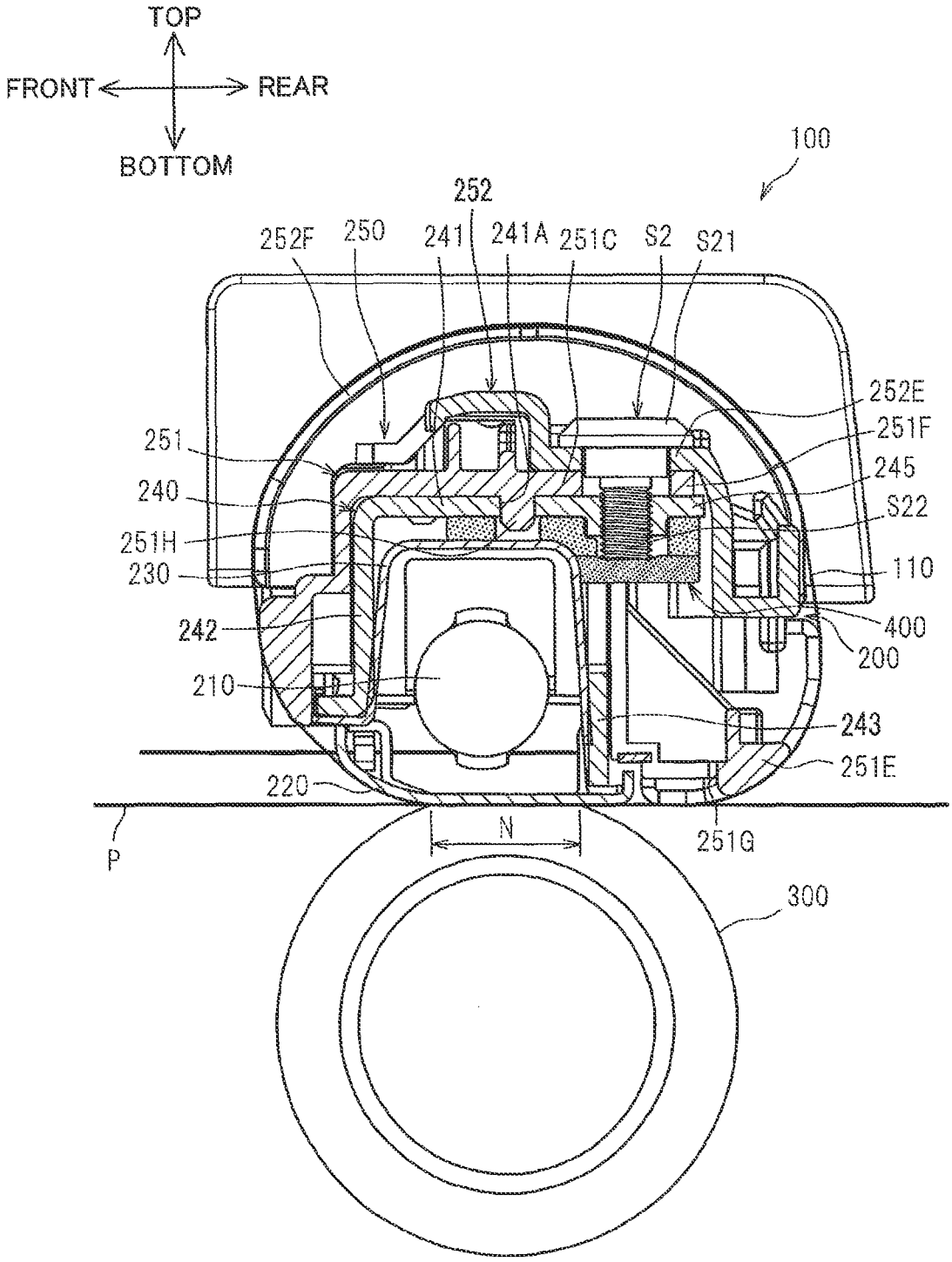
FIG. 2 is a cross-sectional view of the fixing device taken along a plane near a left side screw according to the embodiment.

As shown in FIG. 2, the fixing device 100 includes a fusing belt 110, an internal thermal fixing assembly 200 provided in an internal space of the fusing belt 110, and a backup roller 300 provided outside of the fusing belt 110.

The fusing belt 110 is a tubular endless belt having heat resistivity and flexibility. Circular movement of the fusing belt 110 is guided by guide portions 251E, 252F (described later). Any kind of material is available for the fusing belt 110 such as a metal, for example, stainless steel, and a resin such as polyimide resin.

Figure 3:
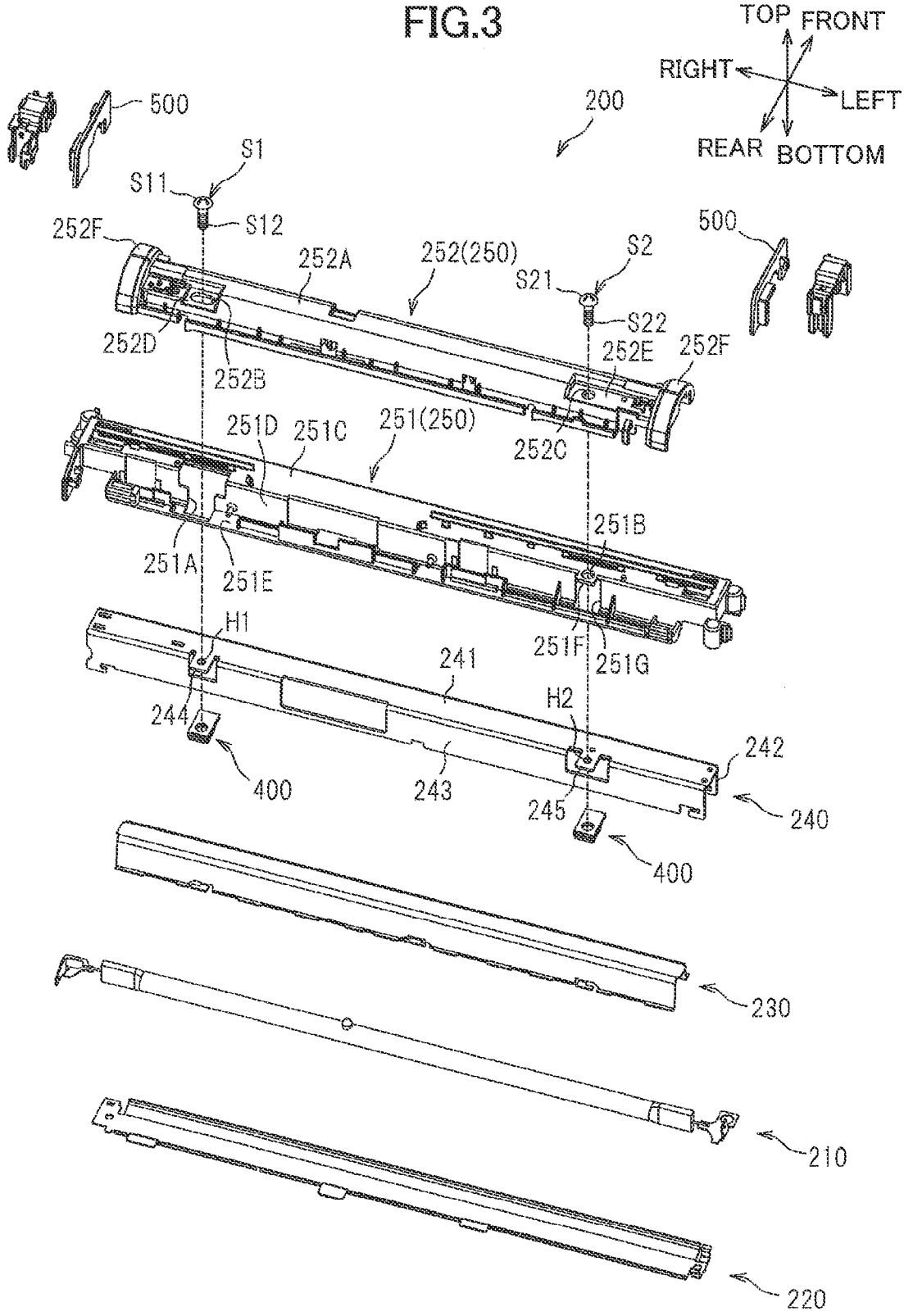
FIG. 3 is an exploded perspective view of an internal thermal fixing assembly in the fixing device according to the embodiment.

As shown in FIGS. 2 and 3, the internal thermal fixing assembly 200 includes a halogen lamp 210, a nip plate 220, a reflection member 230, a stay 240, and a covering assembly 250.

The halogen lamp 210 generates radiant heat for heating the nip plate 220 and the fusing belt 110 to heat the toner on the sheet P. The halogen lamp 210 is spaced away from inner surfaces of the fusing belt 110 and the nip plate 220 by a predetermined distance.

The nip plate 220 is adapted to receive the radiant heat from the halogen lamp 210, and has a lower surface with which the inner surface of the fusing belt 110 is slidably moved. The nip plate 220 is made from an aluminum plate having heat conductivity higher than that of the stay 240 made from steel.

The reflection member 230 has a U-shaped cross-section for reflecting the radiant heat from the halogen lamp 210 to the nip plate 220. The reflection member 230 is positioned spaced away from the halogen lamp 210 by a predetermined distance so as to surround the same. The reflection member 230 is made from a metal plate, such as an aluminum plate, capable of providing high reflection ratio regarding infrared ray and far infrared ray. The aluminum plate is bent into U-shape for formation of the reflection member 230.

The stay 240 is adapted to support front and rear end portions of the nip plate 220. The stay 240 is positioned to cover the reflection plate 230 from an outside thereof and has a U-shaped cross-section in conformance with the U-shaped cross-section of the reflection plate 230. The stay 240 is made from a material having high rigidity such as steel plate bent into U-shape.

More specifically, the stay 240 is positioned opposite to the backup roller 300 with respect to the nip plate 220, and has an upper wall 241, a front wall 242 extending downward from a front end portion of the upper wall 241, and a rear wall 243 extending downward from a rear end portion, of the upper wall 241. The front wall 242 has a lower end portion supporting the front end portion of the nip plate 220 from above through a front flange portion of the reflection member 230, and the rear wall 243 has a lower end portion supporting a rear end portion of the nip plate 220 from above through a rear flange portion of the reflection member 230. That is, each of the front and rear flange portions of the reflection member 230 is nipped between the nip plate 220 and the stay 240.

The stay 240 is adapted to receive force acting from the backup roller 300 onto the nip plate 220, to thus support the nip plate 220. Incidentally, in the depicted embodiment, the stay 240 is urged toward the backup roller 300 with a predetermined urging force by a spring (not shown), so that a reaction force of the urging force is applied to the stay 240 from the backup roller 300 through the nip plate 220. That is, the stay 240 is configured to receive the reaction force from the backup roller 300, thereby supporting the nip plate 220.

The upper wall 241 of the stay 240 is formed with an engagement hole 241A at a left side portion thereof. Further, the upper wall 241 has a rear end portion provided with fixing portions 244, 245 at left and right side portions and extending rearward from the rear end portion. Each free end of each fixing portion 244, 245 is positioned rearward of the rear wall 243. Fixing portions 244, 245 are respectively provided with cylindrical upstanding portions 246, 247 (FIG. 4A) protruding downward by burring.

Each upstanding portion 246, 247 has an inner peripheral surface formed with a screw hole H1, H2 with which a screw S1, S2 is threadingly engaged. Each screw S1, S2 is threadingly engaged with each screw hole H1, H2 from above, so that each head (upper end portion) S11, S21 of each screw S1, S2 is engaged with the covering assembly 250. Thus, the covering assembly 250 is fixed to the fixing portions 244, 245. Incidentally, with this fixing state, each lower end portion (distal end portion) S12, S22 of each screw S1, S2 protrudes downward from each screw hole H1, H2. A sealing member 400 (described later) is provided to each of these protruding lower end portions S12, S22.

The covering assembly 250 is adapted to support a thermistor (not shown) and a thermostat (not shown) those configured to detect a temperature of the nip plate 220. The covering assembly 250 is disposed to cover the stay 240, and includes a first cover member 251 and a second cover member 252.

The first cover member 251 is adapted to cover the stay 240 from above and has a generally U-shaped cross-section. The first cover member 251 has a rear right side portion where a generally T-shaped first notched portion 251A is formed. The screw hole H1 at a right side of the stay 240 is visible from above through the first notched portion 251A. The first cover member 251 has a rear left side portion formed with an insertion hole 251B through which the screw hole 112 at a left side of the stay 240 is visible from above.

Figure 5:
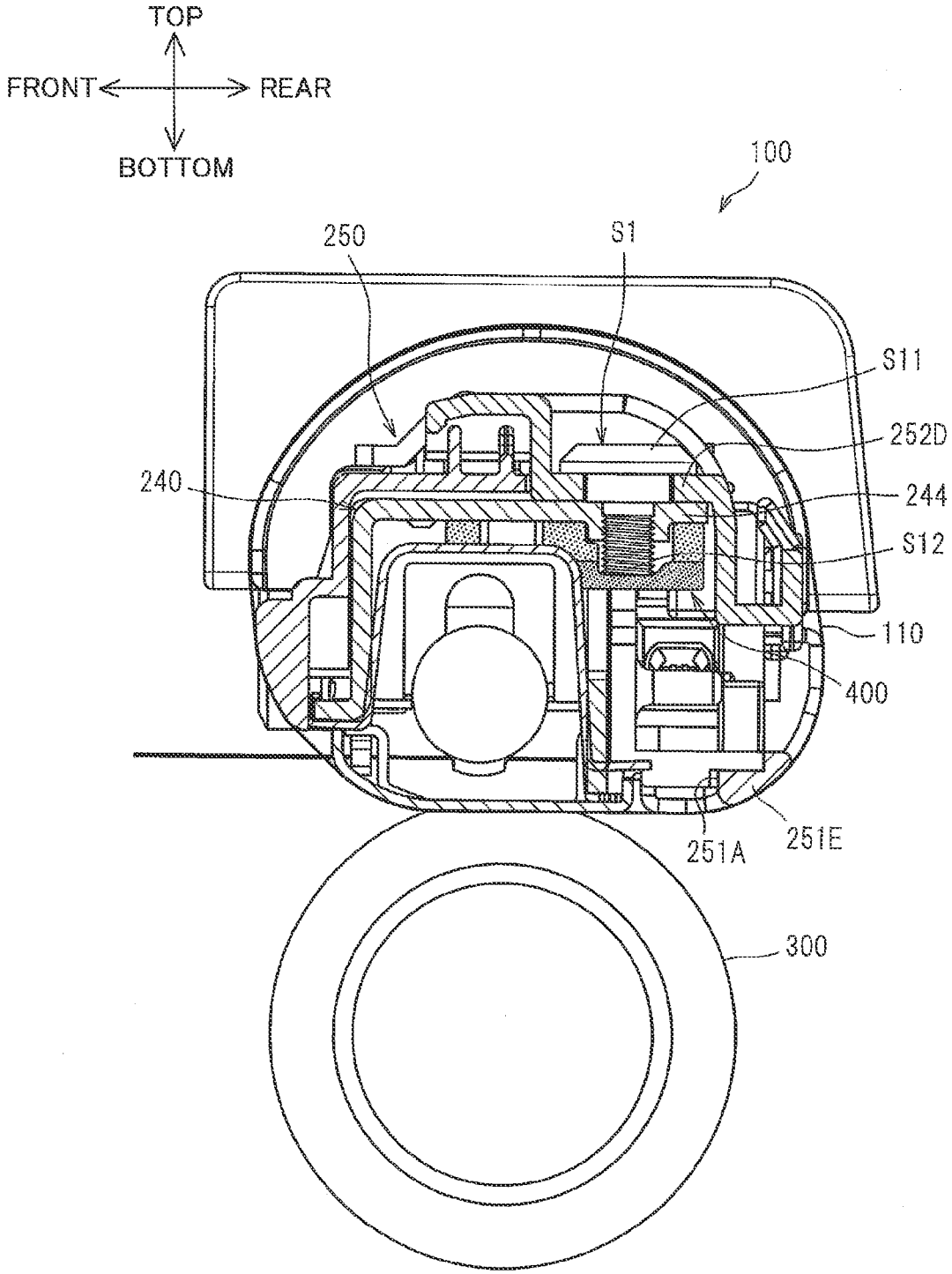
FIG. 5 is a cross-sectional view of the fixing device taken along a plane near a right side screw according to the embodiment.

More specifically, the first cover member 251 has an upper wall 251C, a rear wall 251D, and the guide portion 251E extending rearward from a lower end portion of the rear wall 251D. The first notched portion 251A is formed across the upper wall 251C, the rear wall 251D and the guide portion 251E. With this structure, if the sealing member 400 is not provided, the lower end portion 512 of the screw S1 threadingly engaged with the screw hole H1 at a right side of the stay 240 faces the inner peripheral surface of the fusing belt 110 through the first notched portion 251A (FIG. 5).

A protrusion 251F protrudes rearward from a rear end portion of the upper wall 251C of the first cover member 251. The insertion hole 251B is formed at the protrusion 251F extending vertically through a thickness of the protrusion 251F. A generally rectangular shaped second notched portion 251G is formed across the rear wall 251D and the guide portion 251E at a position below the protrusion 251F (below the insertion hole 251B). With this structure, if the sealing member 400 is not provided, the lower end portion S22 of the screw S2 threadingly engaged with the screw hole H2 at a left side of the stay 240 faces the inner peripheral surface of the fusing belt 110 through the second notched portion 251G (FIG. 2). A projection 251H (FIG. 2) engageable with the engagement hole 241A protrudes downward from the upper wall 251C.

The second cover member 252 is adapted to cover an upper portion of the first cover member 251. The second cover member 252 has an upper wall 252A whose right side is provided with a first screw seat portion 252D recessed downward from an upper surface of the upper wall 252A, and whose left side is provided with a second screw seat portion 252E recessed downward from an upper surface of the upper wall 252A and positioned higher than the first screw seat portion 252D. The first screw seat portion 252D is formed with an elongated slot 252B extending in a rightward/leftward direction to allow the right side screw S1 to extend therethrough. The first screw seat portion 252D is configured to pass through the first notched portion 251A and to be in contact with the fixing portion 244 at a right side of the stay 240. That is, a right side portion of the second cover member 252 is fixed to the stay 240 by the screw S1.

The second screw seat portion 252E is formed with a circular hole 252C which allows the left side screw S2 to extend therethrough. The second screw seat portion 252E is configured to be contacted with the protrusion 251F of the first cover member 251, and the protrusion 251F is configured to he contacted with the fixing portion 245 at a left side of the stay 240. That is, a left side portion of the first cover member 251 and a left side portion of the second cover member 252 are fixed to the stay 240 by the screw S2.

Each lateral (right and left) end of the second cover member 252 is provided with a guide portion 252F in contact with the inner peripheral surface of the fusing belt 110 so as to guide circular movement of the fusing belt 110. Further, each laterally outer end portion of each guide portion 252F is provided with a restricting member 500 for regulating a position of each lateral (right and left) end portion of the fusing belt 110.

The backup roller 300 is positioned below the nip plate 220 and is adapted to nip the fusing belt 110 in cooperation with the nip plate 220. In the depicted embodiment, the nip plate 220 is urged toward the backup roller 300 through the stay 240 by an urging member such as a spring (not shown), thereby providing pressure contact between the nip plate 220 and the backup roller 300, to thus provide a nip region N for thermally fixing the toner image onto the sheet P.

The backup roller 300 is rotationally driven by a drive force transmitted from a motor (not shown) provided in the main frame 2 through a power transmission mechanism (not shown). Upon rotation of the backup roller 300, the fusing belt 110 is driven by way of a friction force generated therebetween or through the sheet P. The sheet P carrying a toner image passes through the nip region N, whereupon the toner image is thermally fixed to the sheet P.

<Detailed Structure of Sealing Member>

The sealing member 400 is configured to cover at least a boundary between the stay 240 and the lower end portion S12, S22 of the screw S1, S2. The boundary used here implies a portion where a bottom edge of an inner peripheral surface of each screw hole H1, H2 formed in the fixing portion 244, 245 of the stay 240 contacts a peripheral surface of each screw S1, S2.

More specifically, in the depicted embodiment, as shown in FIGS. 2, 4A, 4B and 5, the sealing member 400 covers the boundary, peripheral and bottom surfaces of each lower end portion S12, S22 of each screw S1, S2 exposed to an outside through each screw hole H1, H2 formed in each fixing portion 244, 245 of the stay 240, and a portion of the stay 240 including each upstanding portion 246, 247 and a periphery thereof.

With this structure, the sealing member 400 prevents cutting chips (which may be generated by threading engagement of the screws S1, S2 with the stay 240) from leaking outward through the boundary.

Threading engagement of the screws S1, S2 with the stay 240 may generate chips, and such chips may remain in the screw holes H1, H2 or around the screws S1, S2, and may be moved out thereof during transportation of the fixing device 100 or due to vibration in use. Such free chips may be adhered onto the inner peripheral surface of the fusing belt 110, and the chips may be interposed between the fusing belt 110 and the nip plate 220 upon rotation of the fusing belt 110.

However, in the depicted embodiment, the sealing member 400 can prevent the cutting chips from being deposited onto the inner peripheral surface of the fusing belt 110. As a result, damages to the fusing belt 110 can be restrained.

Figures 4A, 4B:
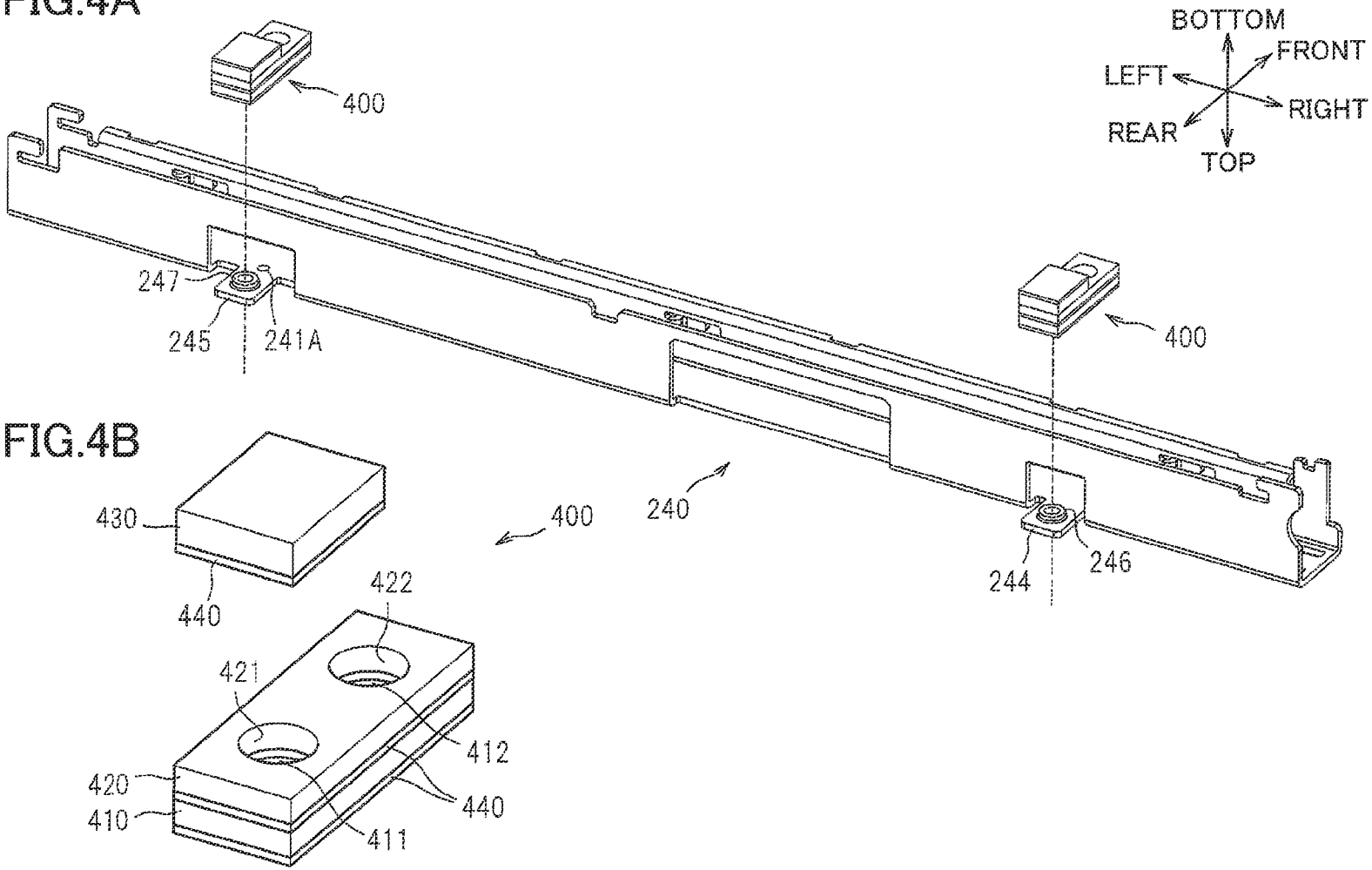
FIG. 4A is a perspective view of a stay in the fixing device according to the embodiment as viewed from a bottom side of the stay.
FIG. 4B is an exploded perspective view of a sealing member in the fixing device according to the embodiment.

More specifically, the sealing member 400 includes first felt members 410, 420, and a second felt member 430 fixed one after another by an adhesive agent (adhesive layers 440). In FIGS. 4A and 4B, the adhesive layers 440 are shown. Incidentally, in FIGS. 2 and 5, the layer construction of the sealing member 400 is simplified, such that the first felt members 410, 420 are shown as a unitary member, and the adhesive layers 440 are not shown for simplicity.

The first felt members 410, 420 extend in a frontward/rearward direction and have rectangular sheet like shape. The first felt members 410, 420 are bonded to each other by the adhesive layer 440.

The adhesive layer 440 preferably has a heat resistivity capable of maintaining an adhesion force against heat during a thermal fixing operation. Such performance can prevent each felt member from peeling off the other felt members and off the stay 240.

The first felt members 410, 420 have rear half portions, each formed with through-holes 411, 421 to allow the screws S1, S2 to extend therethrough. The first felt members 410, 420 have front half portions, each formed with through-holes 412, 422 to allow the projection 251H (FIG. 2) to extend therethrough. Because of formation of the through-holes 412, 422, the sealing member 400 does not interrupt engagement between the first cover member 251 and the stay 240 when the projection 251H of the first cover member 251 is engaged with the engagement hole 241A of the stay 240. Thus, positioning of the first cover member 251 with respect to the stay 240 can be provided.

The second felt member 430 has a sheet like configuration having a size half the first felt member 410, 420, and is bonded to a lower end surface of the first felt member 420 for closing only the through-holes 411, 421. The sealing member 400 thus constructed is fixed to each lower surface of each fixing portion 244, 245 of the stay 240 through the adhesive layer 440 formed over an upper surface of the first felt member 410.

In this way, upon bonding the sealing member 400 to the stay 240, the sealing member 400 covers the lower end portion S12, S22 of the screw S1, S2, and is deformed to be in close contact with the lower end portion S12, S22. More specifically, the two first felt members 410, 420 provide a combined vertical length smaller than a projecting length of the screw S1, S2 from the lower surface of the upper wall 241 of the stay 240 to the distal end of the screw S1, S2. Accordingly, the second felt member 430 is deformed to be in close contact with the lower end portion of the screw S1, S2.

Thus, no vertical gap between the sealing member 400 and the lower end portion S12, S22 of the screw S1, S2 is provided, so that a mass of the sealing member 400 around the lower end portion S12, S22 of the screw S1, S2 can be made compact.

In a structure where the lower end portions S12, S22 of the screws S1, S2 are faced with the inner peripheral surface of the fusing belt 110, the cutting chips may be released from the peripheral surfaces of the lower end portions S12, S22 of the screws S1, S2 due to threading engagement of the screws S1, S2 with the stay 240, and the cutting chips may be deposited on the inner peripheral surface of the fusing belt 110. However, the sealing member 400 can prevent the cutting chips from being deposited on the inner peripheral surface of the fusing belt 110.

More specifically, since the sealing member 400 is provided around the lower end portion S12, S22 of the screw S1, S2, the sealing member 400 can trap the cutting chips falling downward from the lower end portion S12, S22 of the screw S1, S2.

Various variations and modifications are conceivable.

Figure 6:
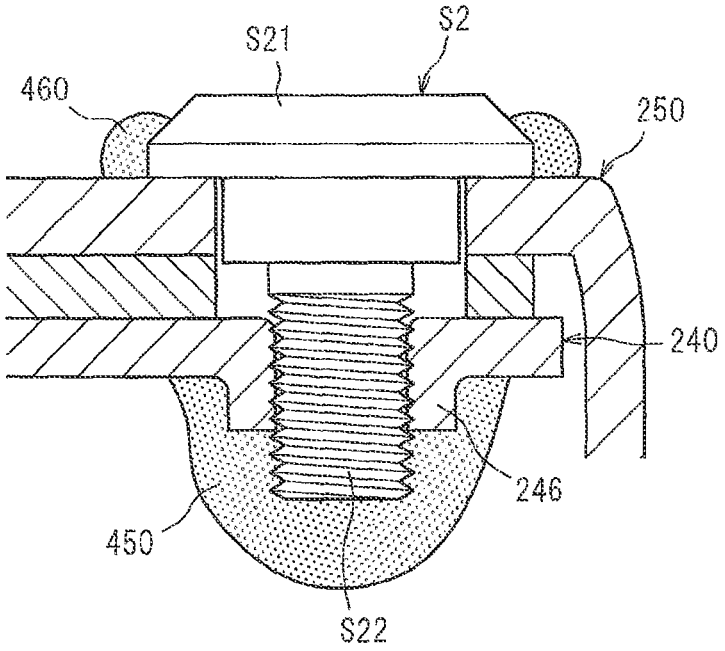
FIG. 6 is a cross-sectional view of a sealing member according to a first modification.

For example, in the above-described embodiment, the sealing member 400 is provided by the felt members 410, 420, 430 and the adhesive layers 440. In contrast, according to a first modification shown in FIG. 6, the sealing member can be exclusively formed of masses 450, 460 of an adhesive agent. A first mass 450 is adapted to cover at least the boundary between the stay 240 and the lower end portion S12, S22 of the screw S1, S2, and a second mass 460 is adapted to cover at least a boundary between the covering assembly 250 and the head S11, S21 of the screw S1, S2 (note that, in FIG. 6, only the screw S2 is shown)

The sealing member may be formed of the first mass 450 only, or alternatively, the sealing member may be formed of the second mass 460 only.

Figure 7:
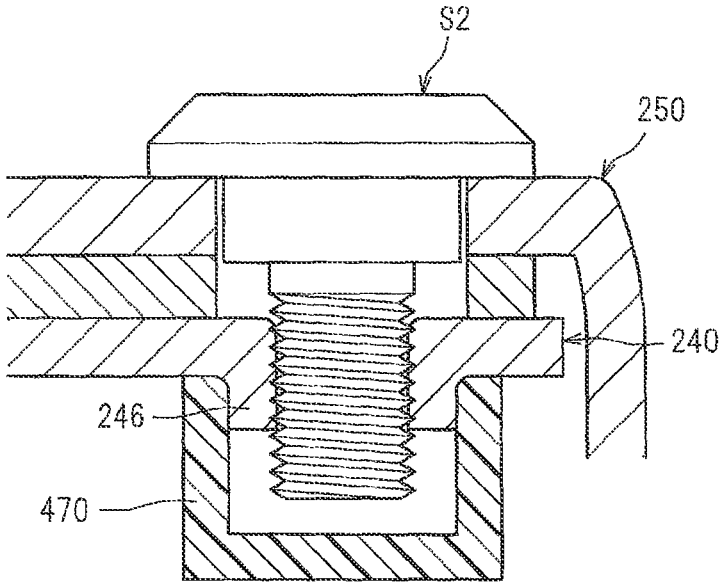
FIG. 7 is a cross-sectional view of a sealing member according to a second modification.

Further, alternatively, as shown in FIG. 7 as a second modification, a cup shaped cap member 470 is provided as the sealing member for fitting with the cylindrical upstanding portion 246, 247 of the stay 240 (note that, in FIG. 7, only the upstanding portion 246 is shown).

Further, in the above-described embodiment, the internal thermal fixing assembly 200 includes the halogen lamp 210 and the nip plate 220. However, in place of the halogen lamp 210, a ceramic heater can be used as the heat source, and a guide member is provided for supporting the ceramic heater and for guiding the inner peripheral surface of the circularly movable fusing belt (tubular member). Such latter structure is also available as the internal thermal fixing assembly.

Further, in the above-described embodiment, the backup roller 300 is provided as the external thermal fixing member. However, a belt-like backup member and a stationary and non-rotatable plate like backup member can be used instead of the backup roller 300.

Further, in the above-described embodiment, the stay 240 is provided as the metallic frame, and the covering assembly 250 is provided as the fixed assembly. However, modification to these assemblies can be made in accordance with the modification to the internal thermal fixing assembly.

Further, in the above-described embodiment, the screws S1, S2 are provided. However, bolts can also be used instead of the screws.

Further, in the above-described embodiment, the felt members are provided which is deformable to be in close contact with the end portion of the screw. However, a sponge is also available instead of the felt members.

Further, in the above-described embodiment, the nip member is a plate like nip plate 220. However, a rectangular parallelepiped nip member having a thickness greater than that of the nip plate 220 is also available as the nip member.

Further, in the above-described embodiment, the stay 240 is urged toward the backup roller 300 by the spring (not shown). However, the backup roller 300 can be urged toward the stay 240 by a spring.

Further, various kinds of the sheet P is available such as a plain paper, a postcard, and an OHP sheet.

While the invention has been described in detail with reference to the embodiment thereof, it would be apparent to those skilled in the art that various changes and modifications may be made therein without departing from the spirit of the invention.

What is claimed is:

1. A thermal fixing device for thermally fixing a developing agent image to a sheet comprising:

a tubular member defining an internal space;

an internal thermal fixing assembly positioned in the internal space of the tubular member and comprising:

a frame made from a metal;

a thread member threadingly engaged with the frame, the thread member having an end portion;

a fixed assembly fixed to the frame by the thread member; and a sealing member covering one of a boundary between the end portion and the frame and a boundary between the end portion and the fixed assembly; and an external thermal fixing member positioned outside of the tabular member and configured to nip the tubular member in cooperation with the internal thermal fixing assembly to provide a nip region at which the developing agent image is thermally fixed to the sheet.

2. The thermal fixing device as claimed in claim 1, wherein the sealing member is formed of a deformable member configured to cover the end portion and in close contact with the end portion.

3. The thermal fixing device as claimed in claim 1, wherein the sealing member includes an adhesive layer adhesively bonded to one of the frame and the fixed assembly, the adhesive layer providing a heat resistivity capable of maintaining an adhesion force against heat during a thermal fixing operation.

4. The thermal fixing device as claimed in claim 1, wherein the tubular member has an inner peripheral surface; and wherein the end portion of the thread member is positioned to face the inner peripheral surface, the sealing member covering the end portion.

5. The thermal fixing device as claimed in claim 1, wherein the fixed assembly is positioned upon the frame; and wherein the thread member includes a head portion seated upon the fixed assembly and a thread portion threadingly engaged with the frame, the thread portion having a free end portion protruding from the frame, the sealing member covering the free end portion.

6. The thermal fixing device as claimed in claim 1, wherein the internal thermal fixing assembly further comprises a nip member providing the nip region in cooperation with the external thermal fixing member; and wherein the frame comprises a stay supporting the nip member at a position opposite to the external thermal fixing member with respect to the nip member.

7. The thermal fixing device as claimed in claim 6, wherein the fixed assembly comprises a cover member covering the stay.

8. The thermal fixing device as claimed in claim 1, wherein the sealing member is formed of a felt member.

* * * * *